US005094061A

United States Patent [19]

Evers

[11] Patent Number: 5,094,061

[45] Date of Patent: Mar. 10, 1992

[54] APPARATUS FOR PACKAGING PRODUCTS

[75] Inventor: Wouter Evers, Hoenderloo, Netherlands

[73] Assignee: Audion Elektro B.V., Hogeweyselaan, Netherlands

[21] Appl. No.: 607,532

[22] Filed: Nov. 1, 1990

[30] Foreign Application Priority Data

Nov. 2, 1989 [NL] Netherlands ..... 8902711

[51] Int. Cl.[5] ..... B65B 43/26; B65B 43/04; B65B 43/28; B65B 43/32

[52] U.S. Cl. ..... 53/567; 53/570; 53/373.6; 53/373.7; 53/574

[58] Field of Search ..... 53/562, 567, 570, 381.2, 53/389.3, 389.4, 389.5, 373.6, 374.8, 51, 455, 373.7, 574; 226/124, 141, 142, 148, 157; 74/25, 89.21, 126

[56] References Cited

U.S. PATENT DOCUMENTS

| | | | |
|---|---|---|---|
| 2,612,738 | 10/1952 | Salfisberg | 53/567 X |
| 3,371,834 | 3/1968 | Willits et al. | 226/141 X |
| 3,381,446 | 5/1968 | Marchand | 53/562 |
| 3,390,617 | 7/1968 | Cloud et al. | 53/562 X |
| 3,529,400 | 9/1970 | Takagaki | 53/567 |
| 3,635,387 | 1/1972 | Gallistel et al. | 226/157 X |
| 3,682,051 | 8/1972 | Sengewald | 53/562 X |
| 3,762,617 | 10/1973 | Matthis | 226/157 X |
| 4,418,513 | 12/1983 | Plahm | 53/373.6 X |
| 4,534,159 | 8/1985 | Kelly | 53/373.6 X |
| 4,580,710 | 4/1986 | Ledgerwood | 226/141 |
| 4,833,867 | 5/1989 | Reichstahler | 53/567 |
| 4,899,520 | 2/1990 | Lerner et al. | 53/389.4 X |

*Primary Examiner*—Horace M. Culver

*Attorney, Agent, or Firm*—Kane, Dalsimer, Sullivan, Kurucz, Levy, Eisele & Richard

[57] ABSTRACT

An apparatus for packaging products in a bag of plastic material comprises means for transporting step by step a continuous tube-like material web with upper and lower layers lying flat one upon the other, a cutting unit for making a cut in the upper layer of the material web, a separating and stretching unit for moving the upper and lower layers away from each other and towards each other, respectively, at the location of the cut, a filling station for filling a formed bag still contained in the material web with the product to be packed and a sealing unit for applying a seal between the upper and lower layers of the material web. The sealing unit makes a strip-like seal extending transverse to the material web and extending in the longitudinal direction of the material web on both sides of the seal. The sealing unit further comprises a cutting means for cutting through the material web at the location of the seal.

9 Claims, 5 Drawing Sheets

APPARATUS FOR PACKAGING PRODUCTS

BACKGROUND OF THE INVENTION

The invention relates to an apparatus for packaging products in a bag of plastic material, more specifically to an apparatus wherein the required bags are formed in the apparatus from a continuous tube-like material web with upper and lower layers lying flat one upon the other.

An apparatus of this kind is disclosed for example in EP-A-0 269 145. Two sealing units are provided in this known apparatus, wherein a first sealing unit applies the bottom seal for a bag and the second sealing unit closes the bag after filling the bag with the product. Beyond the first sealing unit a perforating unit is located, which perforates the material web just behind the first seal, whereafter the perforation in the upper layer of the material web is torn open. This known apparatus has the disadvantage that the construction is rather complicated, while opening the bag by tearing open the perforation owing to circumstances does not occur in the correct manner.

SUMMARY OF THE INVENTION

The invention aims to provide an improved apparatus of the above-mentioned type having a simplified construction so that the apparatus can be manufactured at lower costs.

To this end the apparatus for packaging products in a bag of plastic material comprises according to the invention means for transporting step by step a continuous tube-like material web with upper and lower layers lying flat one upon the other, a cutting unit for making a cut in the upper layer of the material web, a separating and stretching unit for moving the upper and lower layers away from each other and towards each other, respectively, at the location of the cut, a filling station for filling a formed bag still contained in the material web with the product to be packed and a sealing unit for applying a seal between the upper and lower layers of the material web, wherein the sealing unit makes a strip-like seal extending transverse to the material web and extending in the longitudinal direction of the material web on both sides of the seal and wherein the sealing unit further comprises a cutting means for cutting through the material web at the location of the seal.

In this manner an apparatus is obtained including only one sealing unit which simultaneously forms the bottom seal and the seal for closing the bag and moreover releases the closed bag from the material web, at least forms a weakened location in the seal where the bag can simply be separated from the material web. Moreover the cutting unit guarantees a separation of the upper layer by applying the cut, so that auxiliary means for opening a perforation are not required.

According to a favourable embodiment of the invention the separating and stretching unit is provided with two clamps, one at either side of the material web, and with means for moving the clamps between a rest position, a filling position and a sealing position, wherein the clamps in the rest position can engage the longitudinal edges of the material web, in the filling position are moved from the rest position upwardly and towards each other and in the sealing position are moved from the rest position away from each other.

Because the clamps in the filling position are moved upwardly and towards each other, it is guaranteed that the material web is not tightened and play in the upper and lower layers transverse to the material web is created for opening the bag at the location of the cut.

According to a favourable embodiment of the invention the clamps each are mounted on a support arm which is slidable up and down on a guiding rod fixed in a support block, the support blocks being movable back and forth transverse to the longitudinal direction of the material web by a first driving means.

Preferably the apparatus is in this case made in such a manner that the first driving means through a lever also moves up and down the support arm. In this manner it is obtained that the movement of the clamps from the rest position into the filling position is possible by means of only one driving means.

According to the invention the transport means preferably comprises a transport roller for the material web cooperating with a pressure roller, and a linear driving means driving the transport roller through a transmission, wherein an adjustable stop for the linear driving means is provided for adjusting of the length of the material web to be transported at each step. Thereby it is possible in a simple manner to adjust the length of the material web which must be transported for the desired size of the bag.

According to a favourable embodiment of the invention the position of the cutting unit with respect to the longitudinal direction of the material web is adjustable. In this manner the position of the cut in the longitudinal direction of the material web can be adjusted accurately.

BRIEF DESCRIPTION OF THE DRAWINGS

The invention will be further explained by reference to the drawings, in which an embodiment of the apparatus according to the invention is schematically shown.

DETAILED DESCRIPTION OF A PREFERRED EMBODIMENT

Figure 1:
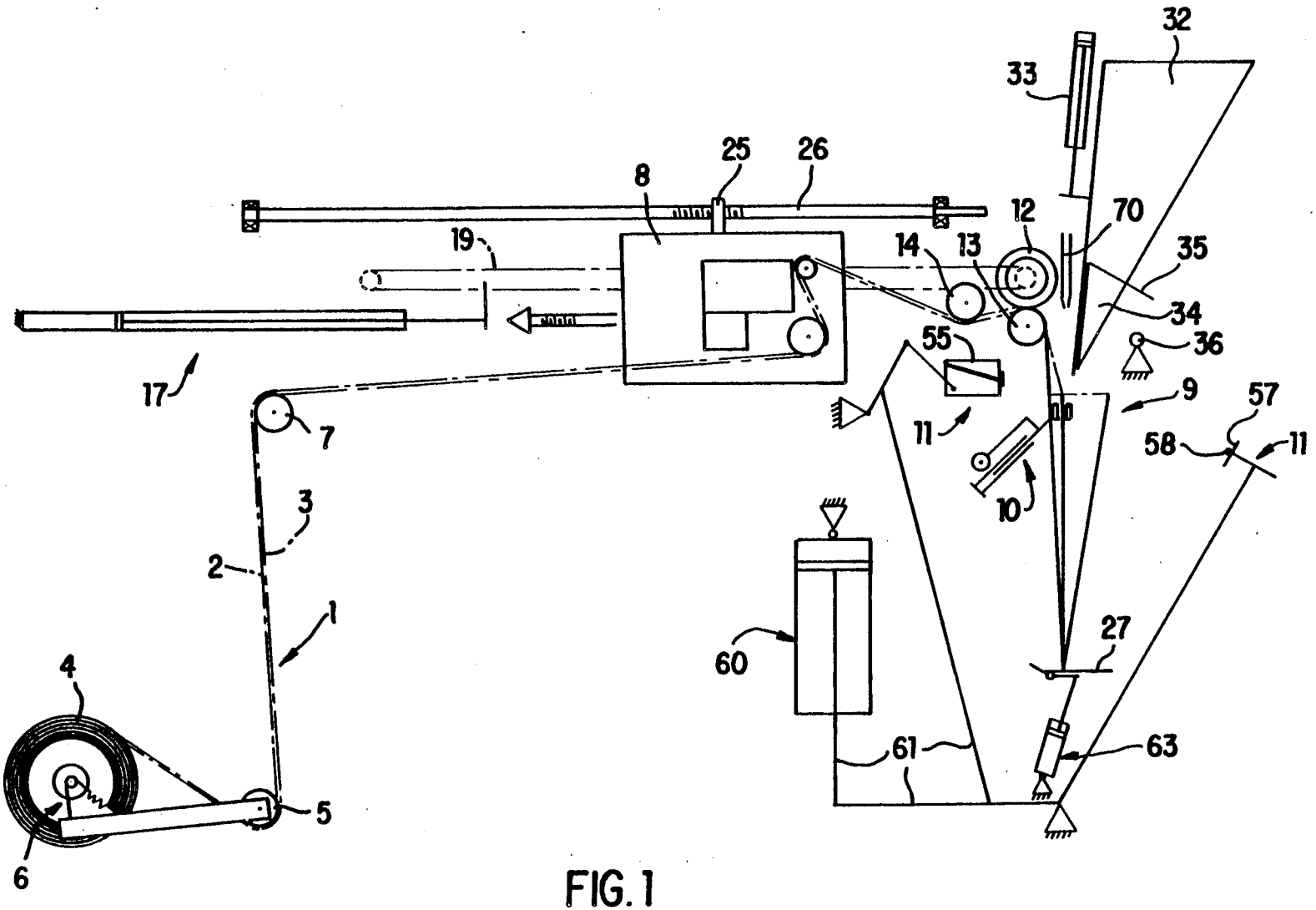
FIG. 1 is a schematically shown side view of an embodiment of the apparatus according to the invention, wherein the supporting frame is omitted for the sake of clarity.

In FIG. 1 there is shown very schematically an apparatus for packaging products in a bag of plastic material, wherein for clarity's sake all frame parts in which the different components are supported, are omitted.

The bags for packaging the product are formed out of a continuous tube-like material web 1 with upper and lower layers 2 and 3, respectively, lying flat one upon the other. The material web 1 is taken from a rotatably supported roll 4 and extends along a roller 5 of a conventional breaking mechanism 6 for the roll 4 to a first guiding roller 7. From the guiding roller 7 the material web 1 extends through a cutting unit 8 to a filling station 9 where a separating and stretching unit 10 and a sealing unit 11 are also located. The material web 1 is transported by a transport roller 12 cooperating with a pressure roller 13. The pressure roller 13 is preceded by a guiding roller 14.

Figure 2B:
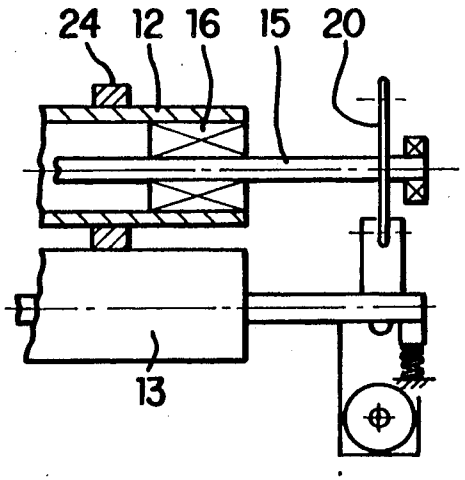
FIGS. 2A and 2B show more detailed the transport means for the material web in side view and cross-section, respectively.
Figure 2A:
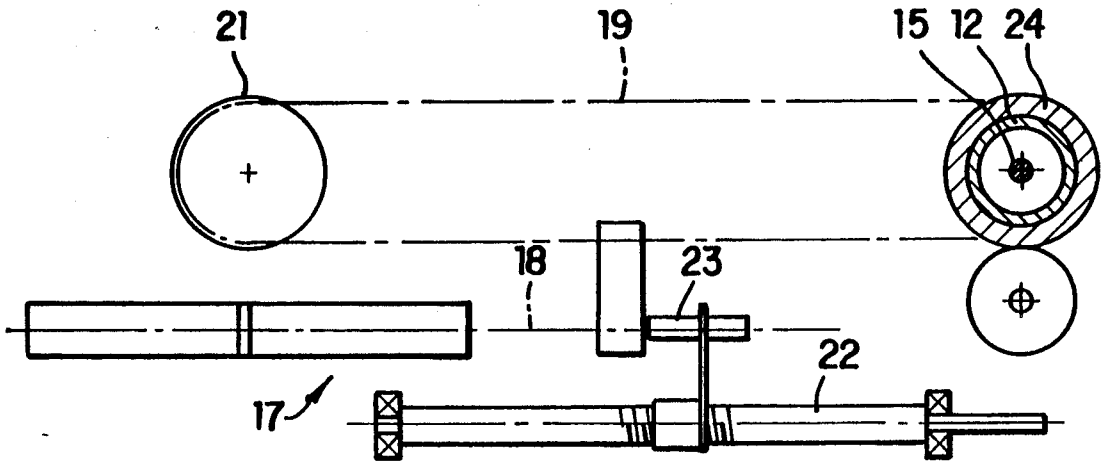

The means for transporting the material web 1 are further shown in FIGS. 2A and 2B. The transport roller 12 is rotatably borne on a driven shaft 15 and at one side coupled with this shaft 15 by a freewheel clutch 16. The shaft 15 is driven by a cylinder piston assembly 17 or another suitable driving means, of which the piston rod 18 is coupled with an endless chain 19 or the like which is guided on a gear 20 attached to the shaft 15 and a gear 21.

The length of the outgoing stroke of the piston rod 18 is adjustable by means of a screwed spindle 22 with which the position of a stop 23 for the piston rod 18 can be adjusted. The stop 23 has a damper function, so that the piston rod 18 is first decelerated and thereafter comes to a stand still. During the outgoing stroke of the piston rod 18 the freewheel clutch 16 is in engagement so that the transport roller 12 rotates with the shaft 15. During the return stroke of the piston rod 18 the freewheel clutch is not in engagement so that the shaft 15 rotates with respect to the transport roller 12.

A plurality of rings 24, one of which being shown in the drawing, with a high coefficient of friction are provided on the transport roller 12, wherein the material web 1 is pressed against these rings 24 by the pressure roller 13 spring supported as shown. During rotation of the transport-roller 12 the material web 1 is transported in this manner along a length determined by the adjustment of the stop 23. In this manner the material web can be transported along a length corresponding with the desired size of the bag for each back and forth going stroke of the cylinder piston assembly 17.

The cutting unit 8 is only schematically shown in FIG. 1. This cutting unit applies a cut in the upper layer 2 of the material web 1, which cut will form the opening of the bag to be filled with the product in the filling station 9, as will be described hereinafter. The cutting unit 8 itself does not make part of the present invention and is further disclosed in a patent application of the same applicant of the same date.

The position of the cutting unit with respect to the longitudinal direction of the material web 1 is adjustable because the cutting unit 8 is guided with a support 25 on a screwed spindle 26. Thereby the position of the cut in the upper layer 2 can be adjusted in such a manner that this cut will be in the correct position in the filling station 9.

In the situation of the apparatus shown in FIG. 1 the material web 1 is arrived with a cut made by the cutting unit 8 in the filling station 9, in which situation a seal formed during the previous operating cycle is substantially on a support 27 which can be swung aside. The stretching and separating unit 10 is also located at the filling station, which unit 10 comprises in the first place a blowing nozzle 70 directing an air stream on the material web 1 at the location of the cut, whereby the upper layer 2 is moved away from the lower layer 3.

Figure 3:
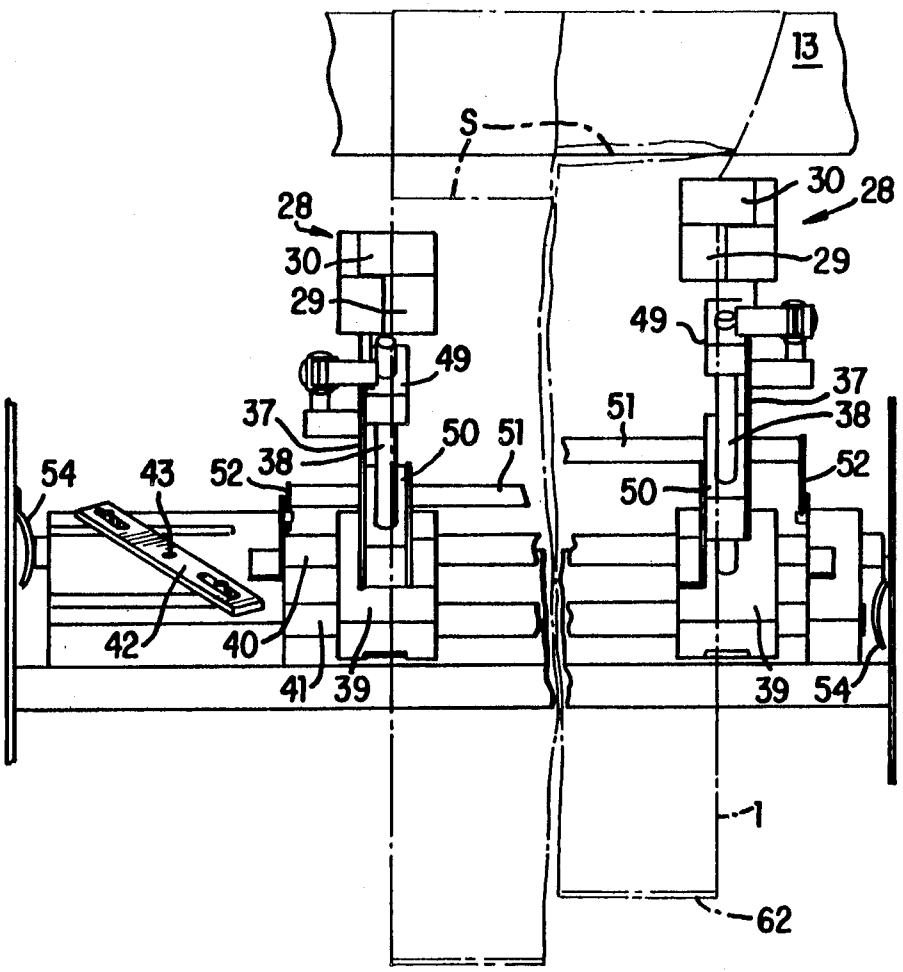
FIG. 3 is a front view of the separating and stretching unit, wherein the left part is shown in the rest position and the right part in the filling position.
Figure 4:
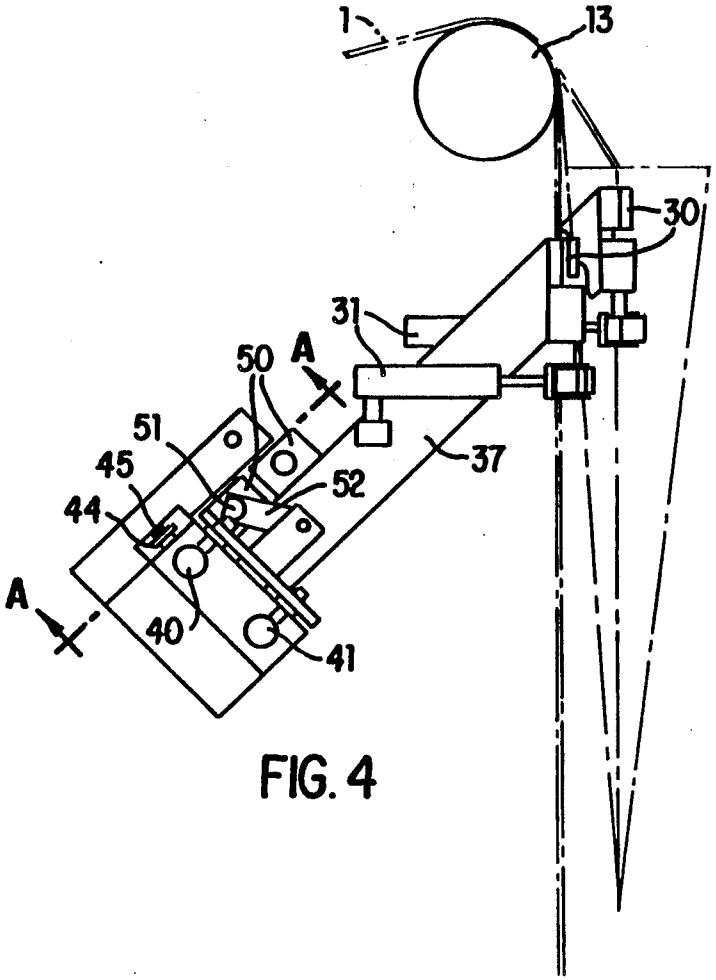
FIG. 4 is a side view of the separating and stretching unit of FIG. 3.

As further shown in FIGS. 3 and 4, the separating and stretching unit 10 further comprises two clamps 28 one on either side of the material web 1. These clamps 28 each include a stationary plate 29 and a rotatable plate 30 actuatable by a cylinder piston assembly 31. In this manner the longitudinal edge of the material web 1 can be grasped between the plates 29 and 30 of the corresponding clamp 28. This grasping of the longitudinal edges of the material weg 1 occurs in a rest position of the clamps 28, which is shown in the left part of FIG. 3. The clamps 28 are movable from this rest position into a filling position shown in the right part of FIG. 3, during which movement the clamps 28 are moved towards each other and upwardly. Thereby the tension in the material web 1 is removed and the upper and lower layers 2, 3 can move further away from each other, so that a filling funnel 32 can be moved into the opened bag. To this end the filling funnel 32 is moveable up and down by a driving means 33, wherein during the downward movement a lid 34 of the filling funnel 32 is opened because a lever 35 is stopped by a boss 36 adjustable in height.

The clamps 28 of the separating and stretching unit 10 are mounted on support arms 37 each being slidable up and down on a guiding rod 38. The guiding rods 38 each are fixed on a support block 39 which support blocks 39 are guided on two rods 40 and 41, respectively, movable back and forth. The support block 39 left in the view of FIG. 3 is fixedly attached to the rod 40 and slidable on the rod 41, whereas the support block 39 right in the view of FIG. 3 is slidable on the rod 40 and fixedly attached to the rod 41. The rods 40, 41 are mutually coupled by a lever 42 which is rotatably borne in the middle at 43.

Figure 5B:
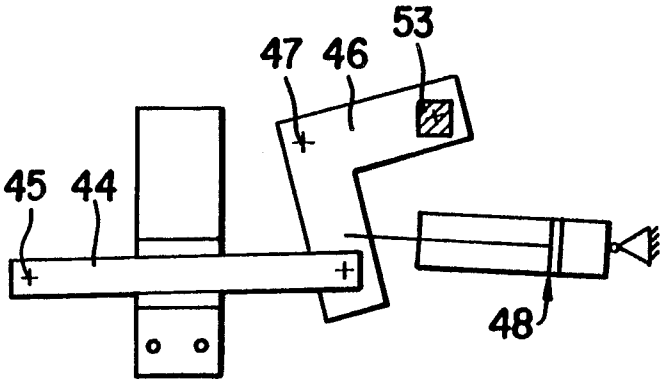
FIGS. 5A and 5B schematically show the driving of the separating and stretching unit in the rest position and the filling position according to the line A—A in FIG. 4.
Figure 5A:
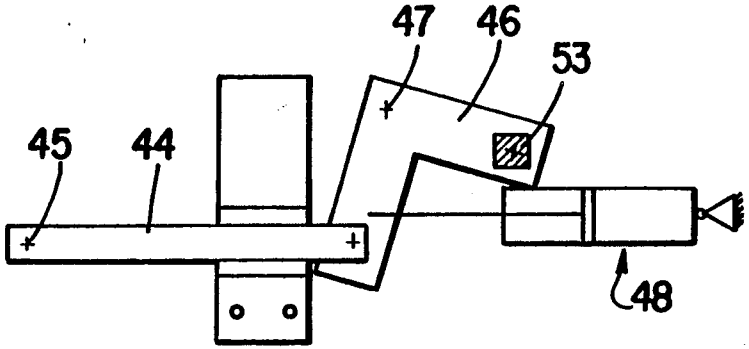

The rod 40 is coupled with a sliding plate 44 which coupling is schematically indicated by 45 in the FIGS. 4, 5A and 5B. The other end of the sliding plate 44 is rotatably connected with the one leg of a mainly L-shaped lever 46 which is rotatably supported at the point indicated by 47. A cylinder piston assembly 48 engages at this lever, which assembly 48 forms the driving means for the rods 40, 41. FIG. 5A shows the rest position whereas FIG. 5B shows the filling position, wherein the sliding plate 44 is moved from the left to the right. Thereby the rod 40 coupled with the sliding plate 44 will also move from the left to the right, so that the clamp 28 left in FIG. 3 will move towards the right clamp 28. Due to the movement reversal provided by the lever 42, the rod 41 will move to the right so that the right clamp 28 moves towards the left clamp 28. In other words during driving by the cylinder piston assembly 48 from the rest position into the filling position, the clamps 28 move towards each other.

As shown in the front view of FIG. 3, the support arms 37 of the clamps 28 each include two sliding blocks 49, 50, with which the support arms 37 are slidable on guiding rods 38. A coupling rod 51 is guided through the lower sliding blocks 50 (see also FIG. 4 where the coupling rod 51 and the sliding blocks 50 are also shown in two positions), which coupling rod 51 is pivotably supported at either side by means of supports 52. This coupling rod 51 is coupled with the other leg of the L-shaped lever 46 by means of a coupling block 53 not shown in FIGS. 3 and 4 and shown in cross-section in FIGS. 5A, 5B. This coupling block 53 is slidable on the coupling rod 51. As appears from a comparison of FIGS. 5A and 5B, the coupling rod 51 is moved upwardly during the movement from the rest position into the filling position, so that thereby the support arms 37 are also slid upwardly on the guiding rods 38 and as a result the clamps 28 are also moved upwardly. By the described construction it is therefore obtained that the desired complex movement of the clamps 28 is obtained by means of only one cylinder piston assembly.

When the filling of the bag still contained in the material web 1 is completed, the clamps 28 are moved from the filling position through the rest position into a sealing position, because the cylinder piston assembly 48 moves the rods 40, 41 beyond the rest position against the action of compression springs 54. Thereby the material web at the location of the cut indicated in FIG. 3 by a S, is stretched so that the upper layer is pulled against the lower layer 3 and a good seal can be obtained.

Figure 6:
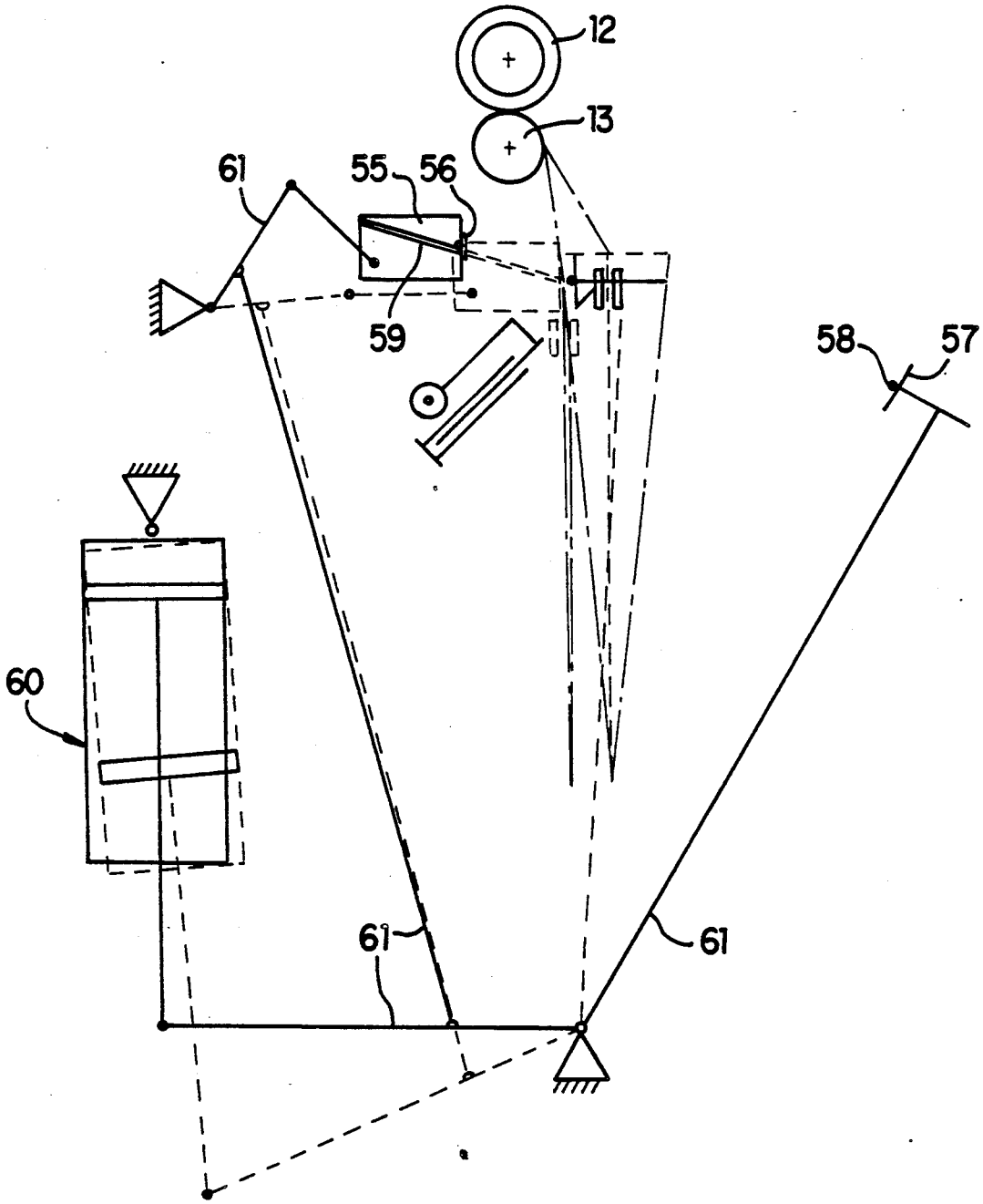
FIG. 6 is a schematically shown side view of the sealing unit of the apparatus of FIG. 1 in a rest position and an operating position.

The sealing unit used is further shown in FIG. 6 in a rest position which is also shown in FIG. 1, and in a sealing position indicated by a dashed line. The sealing unit 11 comprises a sealing beam 55 movable back and forth with a strip-like heating element 56 and a pressure beam 57 movable back and forth with a cutting wire 58. The sealing beam 55 moves due to an oblique guide 59 also downwardly to the desired sealing position indicated with a dashed line. The driving of both the sealing beam 55 and the pressure beam 57 is provided by a single cylinder piston assembly 60 by means of a suitable system of rods 61 shown in the drawing.

The sealing unit 11 applies a strip-like seal 62 (see FIG. 3) transverse to the material web 1 at the location of the cut formed by the cutting unit 8, which seal 62 extends in the longitudinal direction of the material web 1 on both sides of the cut. In this manner it is obtained that with one sealing cycle both the seal for closing the formed bag filled with the product to be packed, and the bottom seal for the next bag are obtained. Further the cutting wire 58 cuts through the material web 1 at the location of the seal 62 so that the filled bag can be separated from the material web 1.

During filling the bag, the same is supported on the support 27 which, after filling the bag and applying the seal 62, can be swung aside by a suitable driving means 63 so that the filled bag can be discharged.

The invention is not restricted to the above-described embodiment which can be varied in a number of ways within the scope of the invention.

I claim:

1. Apparatus for packaging products in a bag of plastic material, comprising means for transporting step by step a continuous tube-like material web with upper and lower layers lying flat one upon the other, a cutting unit for making a cut in the upper layer of the material web, a separating and stretching unit for moving the upper and lower layers away from each other and towards each other, respectively, at the location of the cut, a filling station for filling a formed bag still contained in the material web with the product to be packed and a sealing unit for applying a seal between the upper and lower layers of the material web, wherein the sealing unit makes a strip-like seal extending transverse to the material web and extending in the longitudinal direction of the material web on both sides of the cut and wherein the sealing unit further comprises a cutting means for cutting through the material web at the location of the seal;

wherein the separating and stretching unit is provided with two clamps with web engaging means, with one of said clamps at either side of the material web, and with means for moving the clamps between a rest position, a filling position and a sealing position, and wherein the clamps in the rest position engage the longitudinal edges of the material web, in the filling position are moved from the rest position upwardly and towards each other, and in the sealing position are moved from the rest position away from each other.

2. Apparatus according to claim 1, wherein the clamps each are mounted on a support arm which is slidable up and down on a guiding rod fixed in a support block, the support blocks being movable back and forth transverse to the longitudinal direction of the material web by a first driving means.

3. Apparatus according to claim 2, wherein the first driving means through a lever also moves up and down the support arm.

4. Apparatus according to claim 3, wherein the support arms are coupled with a rod which is pivotably supported and coupled with the driving means through a lever.

5. Apparatus according to claim 3, wherein the driving means moves the support blocks from the filling position through the rest position into the sealing position against the action of springs, and wherein the springs move the support blocks after the sealing action from the sealing position into the rest position.

6. Apparatus according to claim 1, wherein the transporting means comprises a transport roller for the material web cooperating with a pressure roller, and a linear driving means driving the transport roller through a transmission, and wherein an adjustable stop for the linear driving means is provided for adjusting of the length of the material web to be transported at each step.

7. Apparatus according to claim 6, wherein the linear driving means comprises a cylinder piston assembly, the stroke of the piston being adjustable by means of the stop and wherein the piston drives a shaft through a chain or the like, the transport roller being rotatably born on the shaft through a freewheel clutch.

8. Apparatus according to claim 6, wherein the stop is provided with a damper for decelerating the driving means.

9. Apparatus according to claim 1, wherein the position of the cutting unit with respect to the longitudinal direction of the material web is adjustable.

* * * * *